US006695646B1

(12) United States Patent
Grabbe

(10) Patent No.: US 6,695,646 B1
(45) Date of Patent: Feb. 24, 2004

(54) ELECTRICAL CONNECTOR HAVING FLOATABLE CHICKLETS

(75) Inventor: Dimitry G. Grabbe, Middletown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/273,588

(22) Filed: Oct. 18, 2002

(51) Int. Cl.[7] ..... H01R 13/648
(52) U.S. Cl. ..... 439/608
(58) Field of Search ..... 439/65, 608, 79

(56) References Cited

U.S. PATENT DOCUMENTS 5,785,534 A * 7/1998 Longueville et al. ..... 439/65
5,823,823 A * 10/1998 Longueville et al. ..... 439/571
5,893,761 A * 4/1999 Longueville ..... 439/608
5,993,259 A * 11/1999 Stokoe et al. ..... 439/608
6,012,927 A * 1/2000 Longueville et al. ..... 439/65
6,083,047 A * 7/2000 Paagman ..... 439/608
6,343,955 B2 * 2/2002 Billman et al. ..... 439/608
6,431,914 B1 * 8/2002 Billman ..... 439/608
6,471,549 B1 * 10/2002 Lappohn ..... 439/608

* cited by examiner

*Primary Examiner*—Gary Paumen
(74) *Attorney, Agent, or Firm*—Wei Te Chung

(57) ABSTRACT

An electrical connector comprises a plurality of conductive chicklets jointly defining at least a mounting surface adapted to face a motherboard, and a contacting surface adapted to face a daughterboard. Each chicklet defines at least a waveguide extending between the mounting and contacting surfaces. A plurality of differential pair terminals are dielectrically supported within the waveguides and having contacting ends extending beyond the mounting and contacting surfaces so as to electrically couple the motherboard and the daughterboard.

26 Claims, 6 Drawing Sheets

ELECTRICAL CONNECTOR HAVING FLOATABLE CHICKLETS

FIELD OF THE INVENTION

The present invention relates to an electrical connector for printer circuit boards and, more particularly, to a high-speed controlled impedance connector for electrically connecting two circuit boards together.

DESCRIPTION OF THE PRIOR ART

Developments in switching and signal line equipment for telecommunications and data communications demand ever higher performance from all data transmitting components. Typically, a very large "mother board" or back panel, is populated with connectors into which "daughter boards" are inserted. The signal from one daughter board proceeds into the back panel, through the back panel, and into another daughter board or cable. Some signals travel from point to point through a single conductor and some signals travel through a differential pair. There is a tight requirement for preserving signal integrity and to minimize the cross-talk and skew in such transmission lines, whether in the PCB or connector.

U.S. Pat. No. 5,993,259 issued to Stokoe et al disclose an electrical connector of such application. The connector disclosed in the '259 patent includes a plurality of modularized chicklets bounded together. As shown in FIG. 4 of the '259 patent, the terminals are stamped from a metal sheet, then embedded within an insulative material to form the chicklet. However, it can be readily seen from FIG. 4 that the length of each terminal is different from its adjacent terminal because of the right-angle arrangement. In addition, it would be unlikely to make two adjacent terminals with equal length. As long as the terminal length is different from one another, skew between terminals is therefore inevitable.

In addition, it will be difficult to have two adjacent terminals to be configured as a differential pair. By the way, because of the shape of the terminals, it is also unlikely to reach equal impedence between two adjacent terminals.

U.S. Pat No. 6,083,047 issued to Paagman discloses an approach to make a high-density connector by introducing the use of printed circuit board. According to teaching of the '047 patent, conductive traces are formed on surfaces of the printed circuit board in a mirror-image arrangement, typically shown in FIG. 12. Again, the conductive traces formed on the surface of the printed circuit board are unlikely to have the same length. Skew is still inevitable.

In addition, in the above-described patent, distance between two adjacent terminals is too close to intercept a ground contact or conductive trace.

In the '259 patent, even a ground bus is provided, however, the ground bus only electrically separate two adjacent chicklets, while it can not separate two adjacent terminals.

In the '047 patent, since the conductive traces are exposed on the printed circuit board, arranging a ground bus between two printed circuit boards. According to the teaching of the '047, insulative spacer is arranged to two adjacent printed circuit boards, this will not doubt increase the thickness of the overall dimension of the connector, especially when ground buses are arranged therein.

In addition, when the conductive traces are formed on the printed circuit boards, connecting legs/sockets have to be attached to corresponding conductive trace. This will not doubt complicate the make of the connector.

In the '047 patent, even the conductive traces formed on both sides of the printed circuited board, since the connecting portion and tail portions are soldered thereto, the it will be unlikely to reach equal impedence between two terminals.

It is desired to provide an electrical connector which provides a smooth surface of the channel being of monolithic construction so as to achieve signal integrity and to minimize the cross-talk and skew in such transmission terminals of the connector.

U.S. Pat Nos. 5,785,534; 5,823,823; 5,893,761; and 6,012,927 issued to Siemens teach another approach of making the high density connector. As typically shown in FIG. 3 of the '823 patent, the connector generally includes a die-cast housing configured by elements 11*a*, 12*a*, and 13*a* sandwiched between elements 11*a* and 12*a*. The element 13*a* defines a plurality of passageways 14 in which each is assembled with a terminal pair 15 bonded by spacers 16*a*, 16*b*.

One of the problems for the '823 device is those three-piece terminal block is die-casted which means a fixed dimension has to be determined firstly. If another application is required, another die-cast has to be made to meet the requirement.

The channel of the '823 device is made by at least two complex shapes, not a smooth surfaces thereby creating several edges-reflection ???, which produce noise.

On the other hand, since the dimension of the elements 11*a*, 12*a* and 13*a* are fixed, it is unlikely that the connector made therefrom can address the Thermal Coefficient of Expansion (TCE) mismatch induced dimensional changes of the PCB.

SUMMARY OF THE INVENTION

An object of this invention is to provide an electrical connector configured by a plurality of floated chicklets so as to overcome TCE mismatch induced from changes of printed circuit board.

In order to achieve the object set forth, an electrical connector in accordance with the present invention comprises a plurality of die-cast chicklets defining at least a mounting surface adapted to face a motherboard, and a contacting surface adapted to face a daughterboard. Each chicklet defining at least a waveguide extending between the mounting and contacting surfaces. A plurality of terminals dielectrically supported and received within the waveguides and have contacting ends extending beyond the mounting and contacting surfaces so as to electrically couple the motherboard and the daughterboard.

According to one aspect of the present invention, the terminal is supported by plastic or ceramic beads so as to provide largest air dielectric.

According to another aspect of the present invention, the beads arranged on the terminal according to signal requirements.

DETAILED DESCRIPTION OF PREFERRED EMBODIMENT

Figure 4:
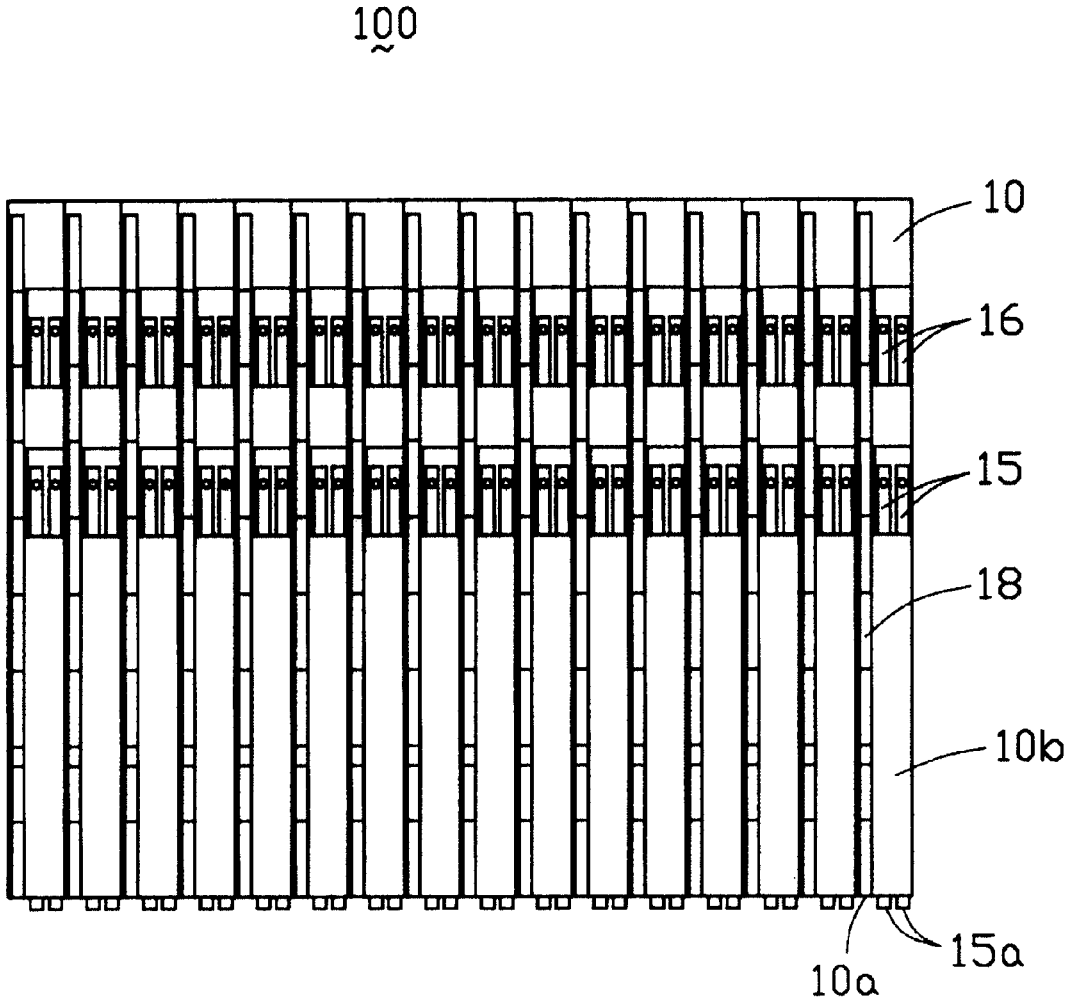
FIG. 4 is a connector configured by the chicklets shown in FIG. 1.
Figure 5:
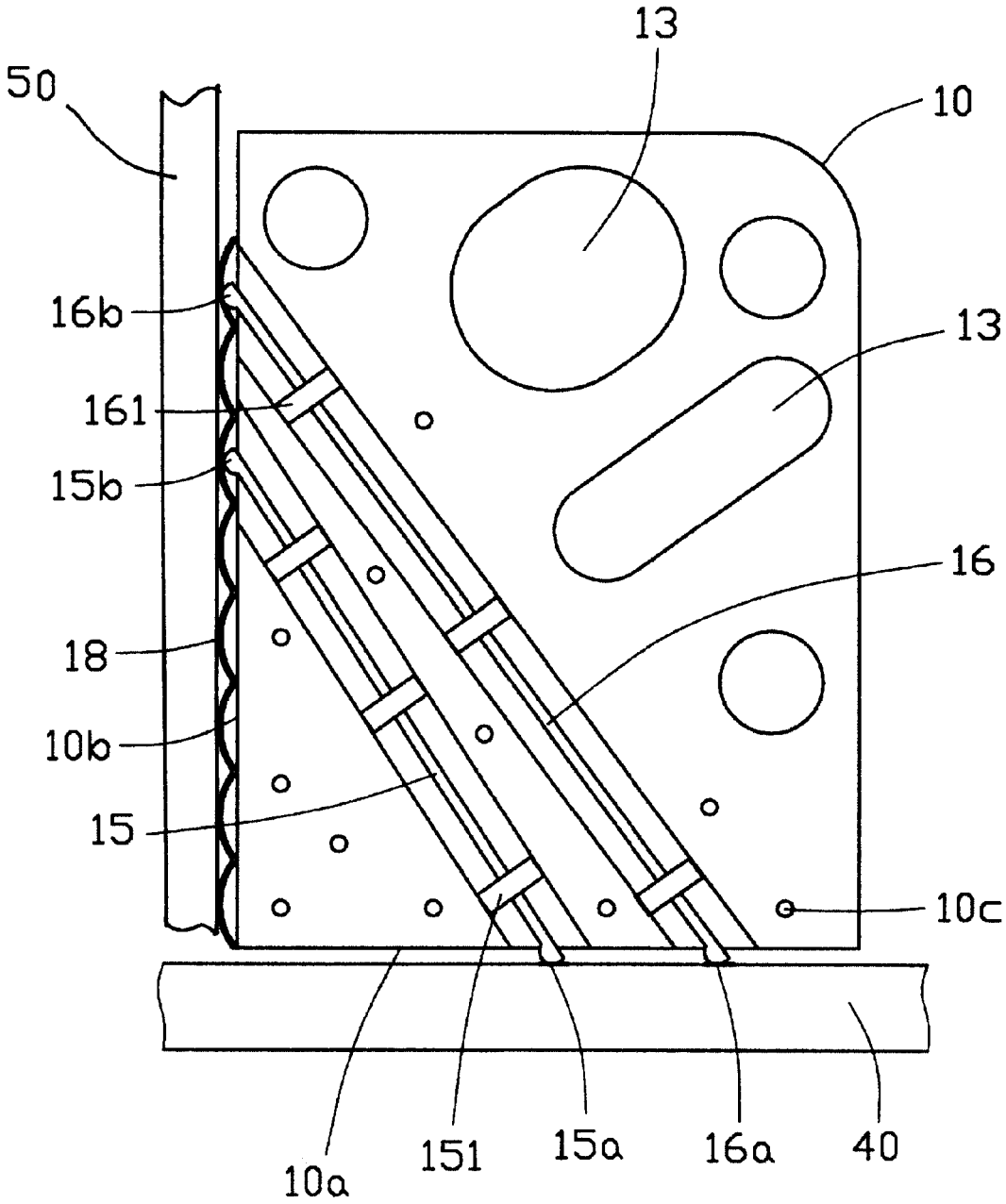
FIG. 5 is a first terminal tail used together with the chicklet.

Referring to FIGS. 1 to 6, a metal module or chicklet 1 in accordance with the present invention includes a base 10 made from die cast or cold impact extrusion processing. The metal can be selected from 6063-T4 Aluminum alloy, and/or 6061-T6 Aluminum alloy, and/or Zinc alloy, or other suitable metal. The chicklet 1 defines a mounting surface 10*a* adapted to face a motherboard 40, and a contacting surface 10*b* adapted to face a daughterboard 50 (FIG. 5). On the other hand, the base 10 can be also injected from a plastic material and metalized by deploying a metal coating over the surfaces.

The chicklet defines a pair of waveguides 11, 12 extending between the mounting and contacting surfaces 10*a* and 10*b*. The chicklet 10 further defines a plurality of recesses 10*c*, and forms a plurality of coupling pins 10*d*. By this arrangement, two and more chicklets 1 can be electrically coupled and interconnected so as to configure a high-density electrical connector 100, referring to FIG. 4. The connector can be configured with any number of chicklets 1 to meet the field requirements.

On the other hand, the base 10 is also defined with a plurality of openings 13 for receiving components of zero-insertion-force (ZIF) mechanism such that the daughterboard 41 can be electrically connected with the connector 100 more easily. Each waveguide 11 (12) is received with a terminal 15 (16) which is dielectrically supported therein by means of insulative beads 151 (161). The insulative beads 151 (161) arranged along the terminals 15 (16) are spaced according to signal requirements so as to reduce noises resulted from reflections.

The reflection is generated when a signal travel along the terminal 15. If the terminal 15 is freely floated within the waveguide 11, and during the travel of the signal along the terminal 15, there is no reflection. However, since the terminal 15 is dielectrically supported within the waveguide 11 by the insulative beads 151 in such a way that a portion of the terminal is discretely surrounded by the insulative beads 151, while the rest is completely exposed within the air. The air and insulative beads 151 carry different dielectric coefficients. As a result, when the signal travels from the air into the insulative beads 151, part of the signal will bounce back (reflection), while part of the signal penetrates. Gradually, the reflection will become noises which negatively influence the normal transmission of the signal. According to the present invention, the insulative beads 151 are arranged right in a "node" so as to reduce or cancel the reflection.

The terminal 15 (16) may have different types of contacting ends. For the contacting end 15*a* (16*a*) facing the motherboard 40, it can be embodied an "eye of the needle" such as the ELCO contact which first emerged in the early 1950's and this is generally referred to as "press-fit", which is typically described in U.S. Pat. No. 4,836,791. With this "press-fit" arrangement, the connector 100 can be easily and electrically mounted onto the motherboard 40 having through holes corresponding to the "press-fit" contacting ends 115*a*, referring to FIG. 6. The other contacting end 15*b* of the terminal 15 could generally be a "compression" or "wipe" type in which the contacting end 15*b* electrically contact with a conductive pad on the daughterboard 41 through surface-to-surface contact. Of course, it should be noted that the invention is not limited to the above described contacting ends only, while others can be applied as well.

Figure 1:
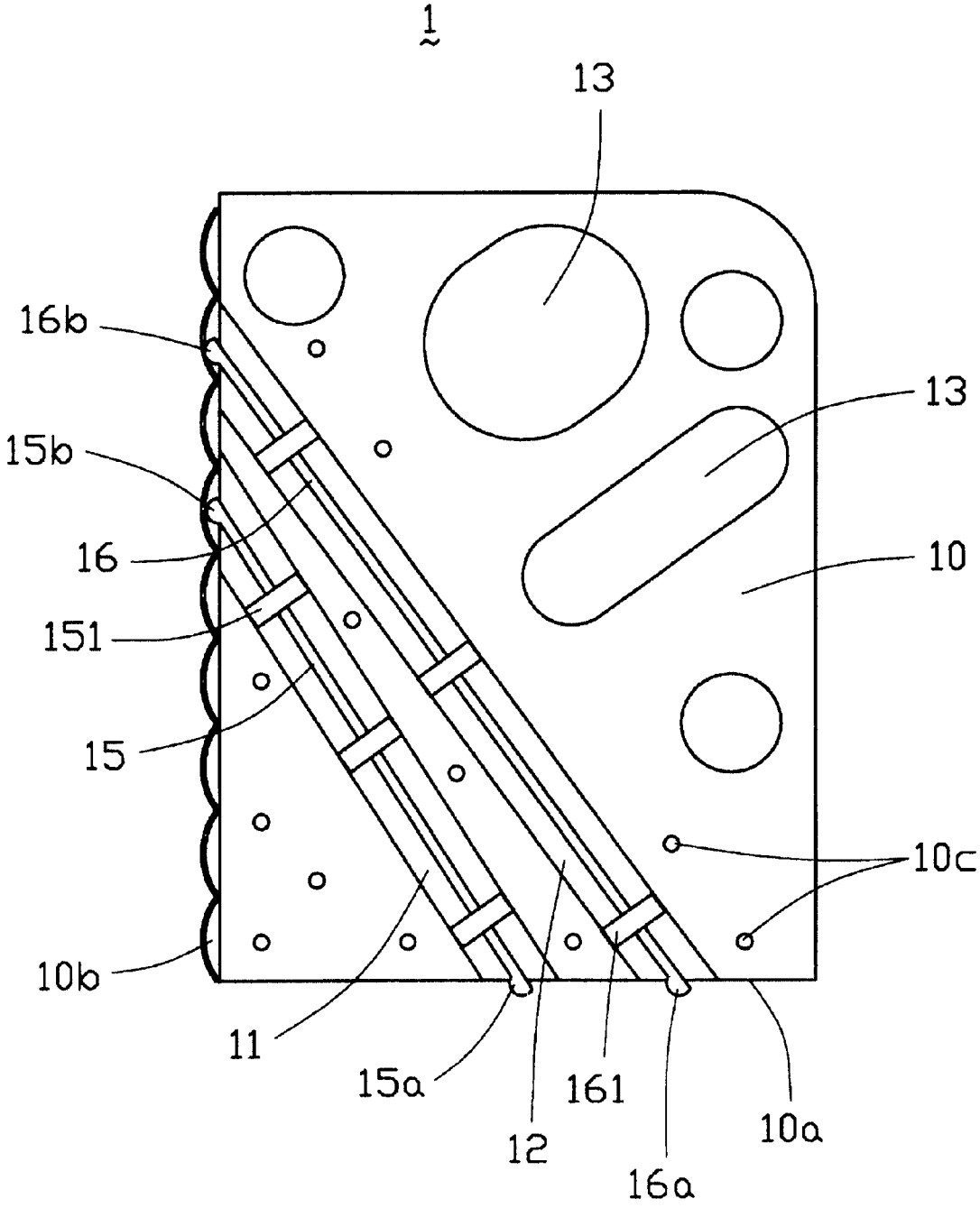
FIG. 1 is a first embodiment of a chicklet in accordance with the present invention.
Figure 2:
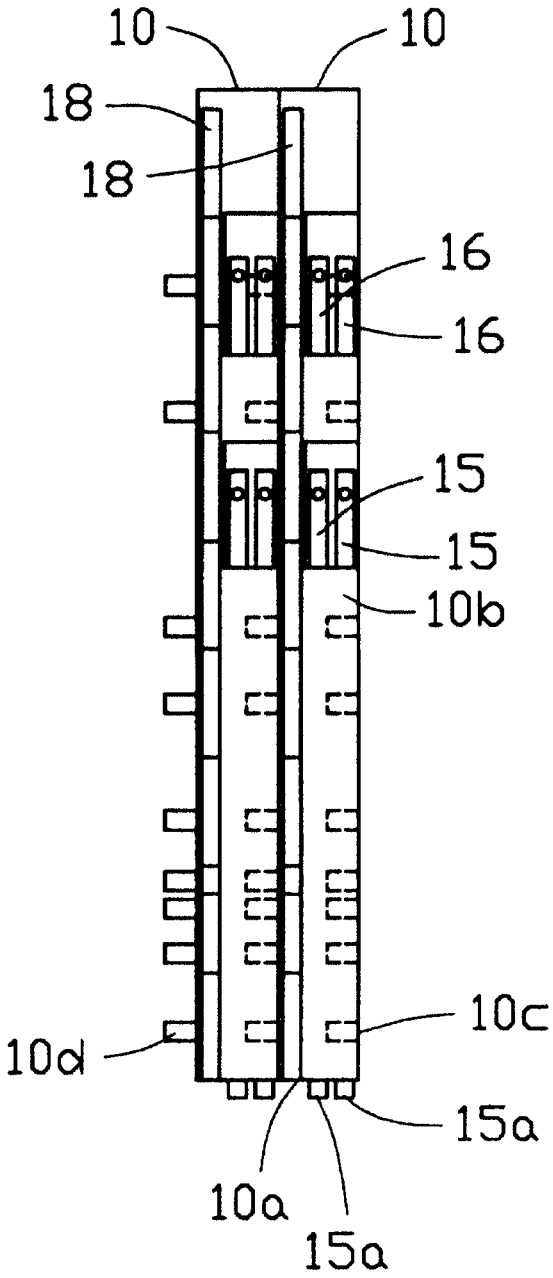
FIG. 2 is a side view of FIG. 1.
Figure 3:
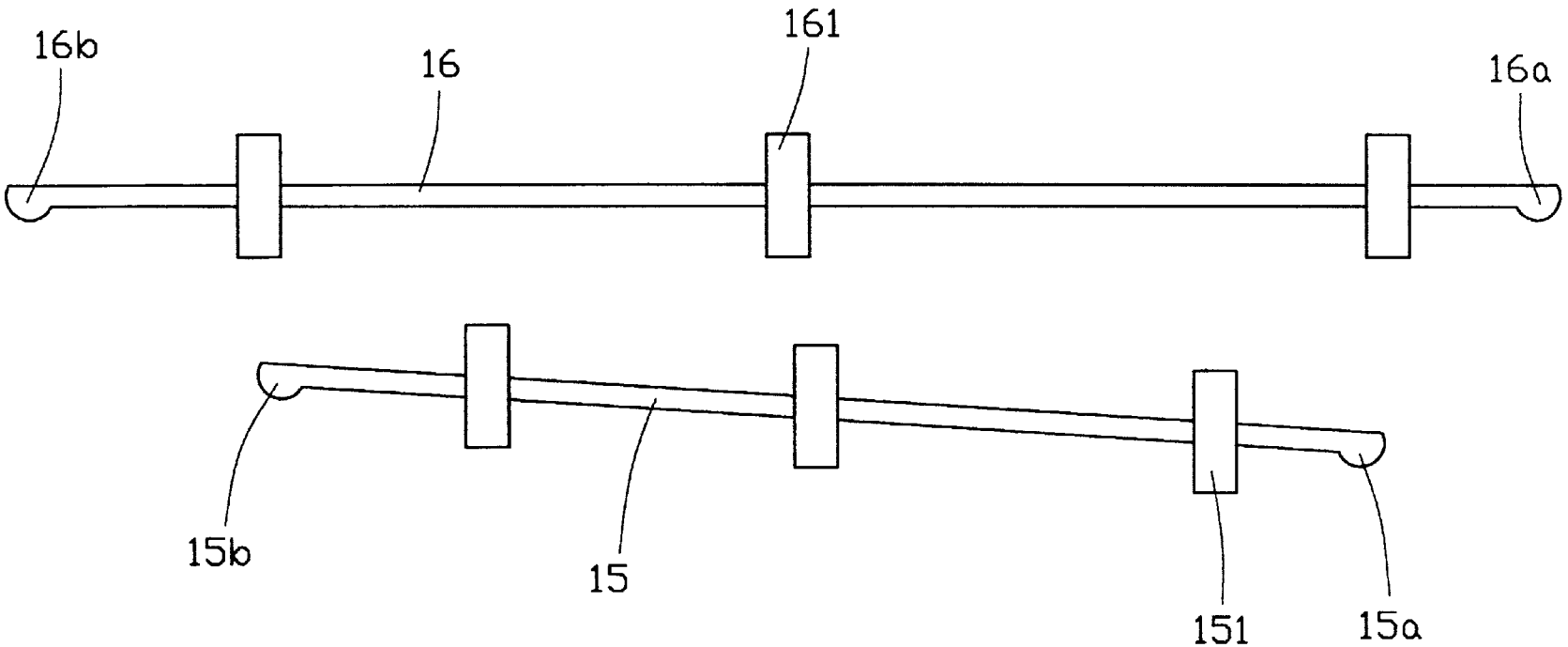
FIG. 3 is a side front view showing a terminal is supported by a dielectric bead.
Figure 6:
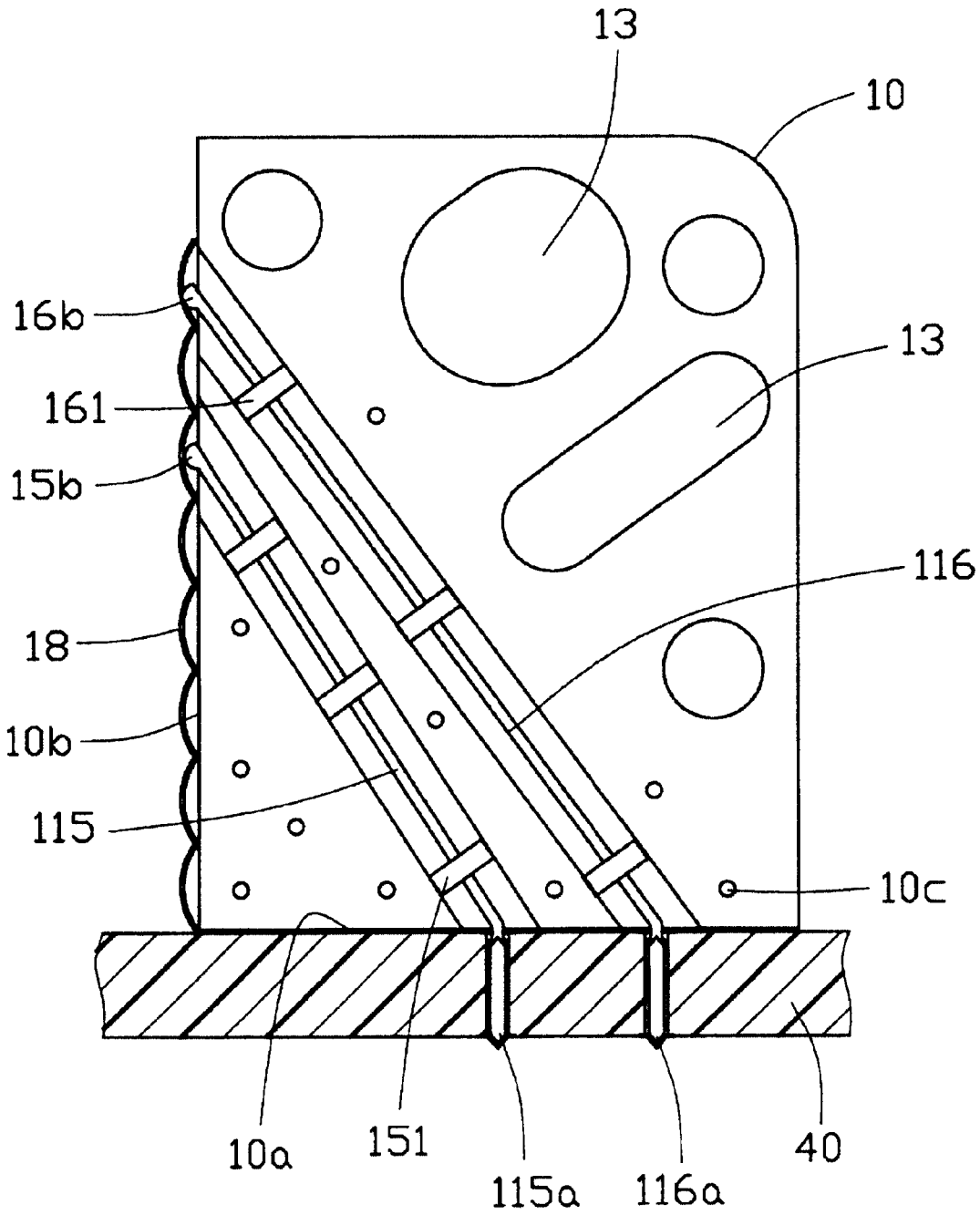
FIG. 6 is a second terminal tail used together with the chicklet.

Referring specially to FIGS. 4 to 6, according to another embodiment in accordance with the present invention, the terminals 15, 16 (FIG. 4) and terminals 115, 116 of FIG. 6) disposed in the waveguides 11 and 111 are differential pair, i.e. two identical terminal transmitting identical signal with opposite phases, as shown in FIG. 2. This differential pair is commonly used in connection in high speed signal transmission because noises imposed thereto can be ultimately subtracted through processing.

The contact face 10*b* of the base 10 of the chicklet 1 is provided with a ground contact 18 which is preferably embodied as a spring wire or a ribbon so as to establish a grounding path with respect to a grounding pad (not shown) on the daughterboard 41. The mounting face 10*a* of the base 10 of the chicklet 1 can be also provided with a same grounding contact such as grounding contact 18.

In addition, FIGS. 5 and 6 disclose two different embodiments of the terminal tails of the terminal 15 (16). The terminal tail 15*a* (16*a*) shown in FIG. 5 is free to slide over conductive pads formed on the motherboard. As mentioned above, the chicklet 1 is provided with the zero-insertion-force mechanism such that the chicklet 1 can be moved toward the daughterboard. This provides an easy maneuver of the daughterboard.

While FIG. 6 discloses another embodiment in which the terminal tails 115*a* (116*a*) embodies as a press-fit tail which snugly fits into a corresponding hole defined in the motherboard.

According to Another Embodiment of the Present Invention

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a plurality of electrically conductive chicklets defining at least a mounting surface adapted to face a motherboard, and a contacting surface adapted to face a daughterboard;

each chicklet defining at least a waveguide extending between the mounting and contacting surfaces; and a plurality of terminals dielectrically supported within the waveguides and having contacting ends extending beyond the mounting and contacting surfaces so as to electrically couple the motherboard and the daughterboard.

2. The electrical connector as recited in claim 1, wherein each chicklet defines a plurality of recesses in a surface in which the waveguide is defined.

3. The electrical connector as recited in claim 2, wherein each chicklet further defines a plurality of coupling pins corresponding to the recesses of the adjacent chicklet so as to electrically couple the chicklets.

4. The electrical connector as recited in claim 1, wherein three sides of the waveguide are defined monolithically with a smooth uninterrupted surface so as to allow high-speed signal transmission with minimal or no reflections.

5. The electrical connector as recited in claim 1, wherein the terminal is dielectrically supported in the waveguide by insulative beads.

6. The electrical connector as recited in claim 5, wherein the beads are spaced according to signal requirements and the beads are coaxially positioned around the terminals such that the portion of the beads cooperate with walls of the waveguide and the terminal to provide spacing between the walls of the waveguide and the terminal.

7. The electrical connector as recited in claim 6, the beads arranged along the terminal is according to signal requirements so as to reduce noises induced from signal reflection.

8. The electrical connector as recited in claim 1, wherein the terminal is configured to follow the shape of the channel such that radius bends provided in the terminal to allow high-speed signal transmission with minimal or no reflection.

9. The electrical connector as recited in claim 1, wherein TCE mismatch is essentially cancelled by floating independent chicklet.

10. The electrical connector as recited in claim 1, wherein the chicklets arranged on a pitch controlled by distances of plated holes of the PCB.

11. The electrical connector as recited in claim 10, wherein positions of the terminals in the relationship to the PCB pattern remains essentially unperturbed during any TCE mismatch induced dimensional changes of the PCB.

12. The electrical connector as recited in claim 1, wherein a common ground contact is arranged between the mounting surface and the motherboard.

13. The electrical connector as recited in claim 1, wherein a common ground contact is arranged between the contacting surface and the daughterboard.

14. The electrical connector at recited in claim 12, wherein the common ground contact is a spring contact.

15. The electrical connector as recited in claim 1, wherein the chicklets are mechanically articulated.

16. The electrical connector as recited in claim 1, wherein the chicklets are made from 6063-T4 Aluminum alloy, and/or 6061-T6 Aluminum alloy, and/or Zinc alloy.

17. The electrical connector as recited in claim 1, wherein a differential pair terminals is arranged in each waveguide.

18. The electrical connector as recited in claim 1, wherein said terminals are arranged as differential pairs.

19. The electrical connector as recited in claim 18, wherein a zero-insertion-force mechanism is arranged in the chicklets.

20. An electrical connector, comprising:

a plurality of electrically conductive chicklets jointly defining at least a mounting surface adapted to face a motherboard, and a contacting surface adapted to face a daughterboard;

each chicklet defining at least a waveguide extending between the mounting and contacting surfaces and having first and second ends;

a plurality of signal launches arranged in the first end of the waveguide for transmitting an electrical signal into a wave; and a plurality of ridge transformers arranged on the second end of the waveguide for transforming the wave into an electrical signal into PCB transmission line.

21. The electrical connector as recited in claim 20, wherein the waveguide serves as a wave guide and is electro polished to reduce noise in the wave guide.

22. The electrical connector as recited in claim 21, wherein the waveguide is electro polished and gold plated.

23. The electrical connector as recited in claim 20, wherein the chicklet is made of plastic metallized on all surfaces.

24. An electrical connector assembly comprising:

first and second printed circuit boards positioned perpendicular to each other;

an electrical connector located in a spaced defined between said first and second printed circuit boards, said connector including:

a plurality of electrically conductive chicklets side by side assembled to one another and commonly defining contacting and mounting surfaces respectively closely but substantially spatially confronting the first and second printed circuit boards for insulation consideration;

each of said chicklets defining at least two waveguides extending linearly but obliquely between and through said contacting and mounting surfaces;

a terminal dielectrically supported, by at least one insulative bead, in each corresponding one of said waveguides, said terminal being spaced from the chicklet for assuring insulation therebetween;

said terminal including contacting ends extending beyond the contacting surface and the mounting surface, respectively, and engaged with the corresponding first and second printed circuit boards; wherein each of said chicklets is positioned perpendicular to both said first and second printed circuit boards.

25. The assembly as recited in claim 24, wherein said at least one insulative bead is located on a node position relative to a high frequent signal passing along the corresponding terminal.

26. The assembly as recited in claim 24, wherein said at least two waveguides extend parallel to each other.

* * * * *